US005911898A

United States Patent [19]

Jacobs et al.

[11] Patent Number: 5,911,898

[45] Date of Patent: Jun. 15, 1999

[54] METHOD AND APPARATUS FOR PROVIDING MULTIPLE AUTOREGULATED TEMPERATURES

[75] Inventors: Stephen M. Jacobs, Cupertino; Cristian Filimon, Los Gatos, both of Calif.

[73] Assignee: Electric Power Research Institute, Palo Alto, Calif.

[21] Appl. No.: 08/450,712

[22] Filed: May 25, 1995

[51] Int. Cl.[6] ..... H05B 1/02

[52] U.S. Cl. ..... 219/505; 219/504; 219/634; 219/486; 219/553

[58] Field of Search ..... 219/504, 505, 219/501, 494, 497, 553, 660, 665, 667, 661, 634, 483–486; 338/22 R, 22 SC

[56] References Cited

U.S. PATENT DOCUMENTS 4,256,945 3/1981 Carter et al. ..... 219/10.75
4,695,713 9/1987 Krumme ..... 219/553
4,701,587 10/1987 Carter et al. ..... 219/10.75
4,752,673 6/1988 Krumme ..... 219/553
4,795,886 1/1989 Carter, Jr. ..... 219/505
5,182,427 1/1993 McGafffigan ..... 219/494
5,194,708 3/1993 Carter, Jr. ..... 219/10.79
5,227,597 7/1993 Dickens et al. ..... 219/10.493

*Primary Examiner*—Mark Paschall
*Attorney, Agent, or Firm*—Burns, Doane, Swecker & Mathis, L.L.P.

[57] ABSTRACT

The present invention generally relates to use of constant current power supply to control temperatures of a device to plural Curie temperatures, without sacrificing the precision and uniformity of temperature achieved in the known devices. In accordance with exemplary embodiments, multiple layers of alloy having different Curie temperatures are separately accessed as an outer most layer is heated through its Curie point. Power to the device can be controlled by varying a frequency of circulating current and by searching to identify a layer of Curie point material which provides heating at a temperature accurately controlled to a fixed value, where any one of a number of different such temperatures may be selected.

23 Claims, 5 Drawing Sheets

METHOD AND APPARATUS FOR PROVIDING MULTIPLE AUTOREGULATED TEMPERATURES

BACKGROUND OF THE INVENTION

1. Field of the Invention

The present invention relates generally to an apparatus and method for generating heat, and more particularly to a method and apparatus for providing plural controlled temperatures using multiple layers of Curie temperature materials.

2. State of the Art

Devices for providing a regulated supply of heat are known. One such device is described in commonly assigned U.S. Pat. No. 4,752,673 (Krumme) which discloses an auto-regulating, electrically shielded heater. The disclosed heater of the '673 patent provides auto-regulated heat at a single regulated temperature. Exemplary embodiments employ a non-magnetic conductive material sandwiched between two magnetically permeable materials of different Curie temperatures to provide a heating surface which can be operated at the single, regulated temperature.

FIG. 3 of the '673 patent illustrates a soldering iron which exploits a "skin effect" to provide the single, regulated temperature. As described in the '673 patent, the FIG. 3 soldering iron includes an electrically conductive, non-magnetic intermediate layer 6. The intermediate layer 6 is sandwiched between an inner magnetic layer 2 used to provide a single regulated temperature heating surface and an outer magnetic layer 4 used to provide electromagnetic shielding. The inner layer 2 is illustrated as an inner cone formed of high permeability, high resistivity, low Curie temperature material such as an NiBalFe alloy. The outer layer 4 is illustrated as an outer cone formed coaxial with and about the non-magnetic intermediate layer 6 and the inner cone 2. The outer cone 4 can be fabricated from a high permeability, low resistivity, high Curie temperature material such as low carbon steel, cobalt or nickel. A constant current AC supply 12 is connected between a center conductor 8 formed of copper and large diameter ends of the inner and outer cones 2 and 4.

In operation, alternating current from supply 12 is confined to a surface of the inner cone 2 adjacent to the return path via the conductor 8. Power dissipation is determined by the equation: $P=I^2R_1$ where $I^2$ is a constant K due to use of a constant current supply, and $R_1$ is a resistance of the inner cone 2 at the frequency of the current supply. Resistance of the inner cone 2 is a function of the material resistivity and the cross-section of the inner cone 2 to which the current is confined by the skin effect. Resistance is an inverse function of cross-sectional area so that as the cross-section of the cone to which the current is confined decreases due to an increase in skin effect, the resistance of the inner cone 2 increases.

The formula for skin depth in a monolithic material is: skin depth=(5030) times the square root of $(\rho/\mu f)$, or $5030\sqrt{(\rho/\mu f)}$ centimeters where $\rho$ is resistivity, $\mu$ is magnetic permeability and f is the frequency of the constant current supply. Thus, skin depth decreases with increased frequency, while effective resistance increases.

As described at column 7, line 38 of the '673 patent, when current is initially applied to the FIG. 3 soldering iron, current is confined to the inner cone 2. The inner cone 2 is of an exemplary thickness which corresponds to one skin depth of Alloy 42 at 90 hertz (Hz). The device heats until the Curie temperature of the inner cone 2 material is attained (e.g., approximately 325° C.). Once this temperature is achieved, the permeability of the inner cone 2 material decreases and current begins to spread into the intermediate layer 6 and the outer cone 4. The temperature of the material of the outer cone 4 is well below its Curie temperature and the current is therefore confined to the inner cone 2, the intermediate layer 6 and to a few skin depths of the outer cone 4 at 90 Hz.

In other words, as the Curie temperature of the inner cone 2 is attained, its magnetic permeability rapidly decreases and current spreads into the intermediate layer 6 and into the outer cone 4. Thus, the total resistance of the structure due to the presence of the highly conductive intermediate layer 6 drops dramatically to provide a high auto-regulating ratio. Further, most of the current is confined to the highly conductive intermediate layer 6 and only a small percentage penetrates the outer cone 4. The outer layer 4 is therefore only 3–5 skin depths thick to effect virtually complete shielding of the device. This permits a large auto-regulating power ratio to be realized in a relatively small device using a low frequency source (e.g., 50 Hz to 10 kHz).

U.S. Pat. No. 4,701,587 (Carter et al), U.S. Pat. No. 4,695,713 (Krumme) and U.S. Pat. No. 4,256,945 (Carter et al) also relate generally to structures which exploit an auto-regulating feature to provide single temperature heating surfaces. Despite the significant advantages realized by the methods and apparatus described in these patents, they are primarily directed to generating accurate control at a regulated fixed temperature. It would therefore be desirable to exploit advantages of these patents to achieve control at any one of plural user selected temperatures.

SUMMARY OF THE INVENTION

Accordingly, the present invention is directed to using an auto-regulating feature to provide a heating structure which can be controlled to selectively produce heat at any one of plural regulated temperatures, without sacrificing precision and uniformity with which any of the selected temperatures is maintained. In accordance with exemplary embodiments, multiple layers of alloy having different Curie temperatures, are separately accessed as an outer most layer is heated through its Curie point to select one of the plural auto-regulated temperatures. To select a desired layer and temperature of operation, power to the device can be controlled by varying the frequency of the circulating current. By selecting an appropriate layer of Curie point material, a heating system can provide a heating surface which is accurately controlled to any one of plural, relatively constant regulated temperatures.

Exemplary embodiments of the invention include means for generating a constant current; and means for producing heat at any one of plural relatively constant temperatures in response to said constant current generating means. Exemplary embodiments of the heat producing means include at least one electrically conductive, non-magnetic material; and at least two layers of magnetically permeable material, a first of said at least two layers having a first Curie temperature and a second of said at least two layers having a second Curie temperature different from said first Curie temperature, said non-magnetic material being cooperatively arranged with said first layer and said second layer to selectively produce heat at a temperature selected from among said first Curie temperature and said second Curie temperature.

Exemplary embodiments further relate to a heater comprising a core having at least one electrically conductive, non-magnetic material; and at least two layers of magnetically permeable material, a first of said at least two layers having a first Curie temperature and a second of said at least two layers having a second Curie temperature different from said first Curie temperature, said core being cooperatively arranged with said first layer and said second layer to produce heat at a temperature selected from among said first Curie temperature and said second Curie temperature.

Additional embodiments relate to an apparatus for generating a heat supply comprising means for selectively producing heat at any one of plural, relatively constant temperature operating points, each of said operating points being produced by a separate material having a Curie temperature which corresponds to one of said plural, relatively constant temperature operating points; and means for controlling said heat producing means at one of said operating points in response to electrical properties of the heat producing means.

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
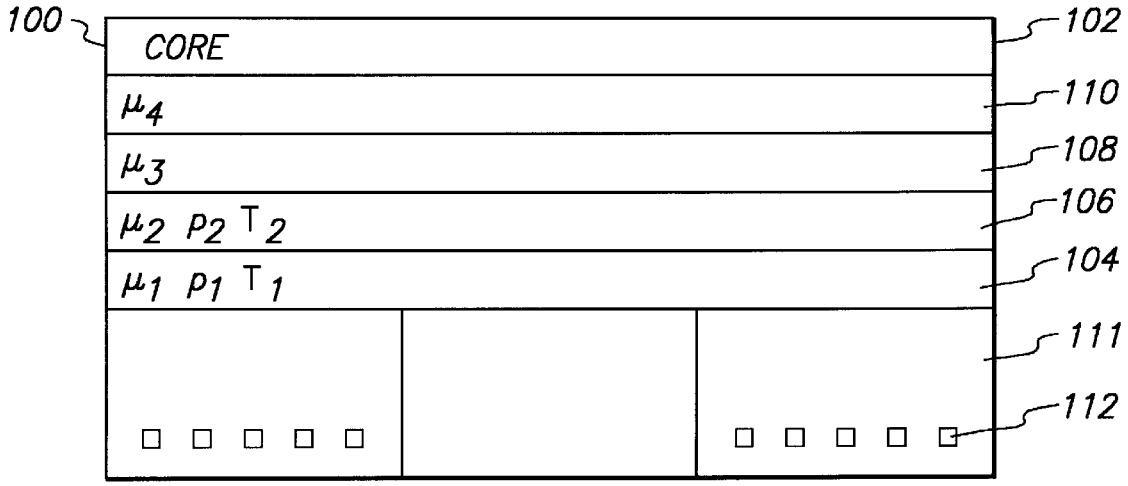
FIG. 1 shows an exemplary embodiment of a heater structure in accordance with the present invention.

FIG. 1 shows an exemplary embodiment of an apparatus for generating heat, the apparatus being formed as a heater structure which includes a single construction, laminated structure 100 which can be operated at plural, relatively constant, regulated temperatures using layers of different Curie temperature materials. The exemplary structure of FIG. 1 can be formed by depositing or laminating any number of multiple layers of alloy, each of which can have a different Curie temperature, together into a single plate construction. One of the layers of material having a given Curie temperature can be accessed as an outermost layer of the heater structure is heated through its Curie point. In addition to lamination or deposition of the multiple layers of the FIG. 1 embodiment, those skilled in the art will recognize that any number of different techniques can be used to form the structure illustrated. For example, hot or cold rolling, extrusion, cladding, metallurgical techniques and so forth can also be used.

Power can be applied to the plate structure directly or through an inductive coupling. The selection and regulation of temperature at any one of plural predetermined operating points can be controlled as a function of electrical properties of the plate structure (e.g., resistance, power dissipation, or any property which is a function of electrical resistance). The selective operation at one of the available temperatures can be achieved by selecting thicknesses of materials used (i.e., to establish a fixed operating point of the FIG. 1 plate structure for a given power supply). Alternately, selective control can be achieved by operating the power supply (e.g., adjust frequency or pulse width) to change the operating point of the FIG. 1 structure. By selectively varying the power, the electrical properties of the plate structure will alter the operating point to redistribute current within the multi-layer plate structure and change the material layer currently operating at its Curie temperature.

The power supply used in the exemplary embodiment of FIG. 1 can be a "smart" power supply which is controlled in response to detected properties of the multilayer structure to latch a predetermined operating point. When one of the plural predetermined operating points has been selected by adjusting the power supply, a relatively constant temperature can be maintained by controlling operation at the selected operating point using known techniques which need not be described here in detail (e.g., in a manner as described in the aforementioned U.S. Pat. No. 4,752,673, the disclosure of which is hereby incorporated by reference in its entirety).

Further details of exemplary embodiments will now be provided. Referring to FIG. 1, a heater structure 100 is illustrated which includes a core formed of at least one electrically conductive, non-magnetic material 102 having at least a first side. In accordance with an exemplary embodiment, the core layer 102 can be any highly conductive, non-magnetic material (e.g., aluminum, copper and so forth). Further, the heater structure 100 includes at least two layers of magnetic material, such as layers 104 and 106, formed on said first side. In the exemplary FIG. 1 embodiment, a first layer 104 has a first magnetic permeability $\mu_1$, a first reflected resistance $R_1$, a first Curie temperature $T_1$ and a first resistivity $\zeta_1$, while the second layer 106 has a second magnetic permeability $\mu_2$, a second reflected resistance $R_2$, a second Curie temperature $T_2$ and a second resistivity $\zeta_2$. Reflected resistance is a function of power supply frequency and material temperature.

The core 102 is cooperatively arranged with the first and second layers to produce heat at a temperature selected from among the first Curie temperature and the second Curie temperature. As referenced herein, the phrase "cooperatively arranged" refers to placement of the core relative to the magnetic layers such that electrical current can pass directly or inductively into the magnetic layers until the selected operating point is reached. The plate structure can then be selectively controlled to operate at either one of the Curie temperatures $T_1$ or $T_2$.

In accordance with alternate embodiments, the FIG. 1 heater structure can further include additional layers 108 and 110. These additional layers can be magnetic layers, having magnetic permeabilities of $\mu_3$ and $\mu_4$, respectively and having associated Curie temperatures $T_3$ and $T_4$, respectively (e.g., with $T_4>T_3>T_2$). Thus, an inclusion of layers 108 and 110 in the exemplary FIG. 1 embodiment represents an ability of the present invention to include any number of magnetic layers. Each of these additional layers can have its own independent Curie temperature which can be selected to operate the heater structure at additional Curie temperatures associated with the materials used.

The FIG. 1 heater structure can be controlled to selectively operate at any one of the Curie temperatures associated with the various materials used to form the plate, and can be used in any number of products. For example, such a structure can be used to provide multiple temperature soldering tips, with a low temperature being selected for use with low temperature solder and with a high temperature being selected for high temperature solder. Alternately, a heater structure as illustrated in FIG. 1 can be used in cooking grills to provide a heating surface selectively operable at any one of plural, relatively constant temperatures for cooking various types of food. In this manner, the plate structure can be used as a cooking griddle plate similar to that described in commonly-assigned U.S. Pat. application Ser. No. 07/745,843 entitled "Rapid Heating, Uniform Highly Efficient Griddle," filed Aug. 16, 1991, but can provide operation at plural temperatures.

In accordance with exemplary embodiments, a controllable switch is provided to select a temperature setting which corresponds to the effective Curie temperature of a layer included in a plate structure. Such a switch can be a user or factory controlled switch that controls power to coils 112 for inducing current in the plate structure. The coils 112 can be included in insulation 111. In the case of a heater structure having two layers of different Curie temperatures, the switch can be set to a $T_2$ setting to select a higher temperature. Alternately, the switch can be set to a lower temperature $T_1$ setting.

The available switch ratio (i.e., the resistance versus temperature operating characteristics of the heating structure) is limited to the ratio of the skin depth below and slightly above $T_1$ for heater structures, where $T_2$ is greater than $T_1$. When the actual temperature T is less than $T_1$, skin depth is equal to $5030\times\sqrt{(\rho/\mu f)}$ cm, and when T is greater than $T_1$, $\mu_1$ can be considered equal to 1 such that skin depth is equal to $5030\times\sqrt{(\rho/f)}$ cm (i.e., where above the Curie temperature the magnetic permeability is approximately 1 and the ratio is approximately 20 ohms:1 ohm before switching current enters the second layer).

When the switch is set for operation at the lower temperature $T_1$, a current is constrained in the first low temperature layer 104. To ensure operation at the operating point associated with this temperature, the "smart" power supply of FIG. 1 includes means for detecting an operating point of the plate structure as a function of electrical properties of layers included in the plate structure. For example, the detecting means can include means for monitoring reflected resistance, or any derivative thereof, to reduce the power output of the power supply until the reflected resistance reaches a stable equilibrium.

A stable auto-regulated equilibrium can be achieved by controlling the applied voltage from the power supply to maintain operation at $T_1$ . After detecting relative stability in reflected resistance despite a continuing increase in the power supply (e.g., by increasing frequency or duty cycle of the power supply voltage), detection of a relatively small decrease in reflected resistance will cause the power supply to limit the power beyond what would otherwise be produced until the reflected resistance begins to increase. At that point, the plate structure can be considered to have begun to cool such that more power is output to stabilize the plate at $T_1$.

Thus, the system monitors reflected resistance to maintain operation at a given operating point. The first layer 104 can be made sufficiently thick such that when the Curie temperature of $T_1$ is reached, the power supply detects a change in reflected resistance at the frequency used to select the $T_1$ operating point. The power supply also keeps track of which temperature region the plates are operating in and detects whether the actual temperature T is less than $T_1$.

On the contrary, when the switch is set to the higher temperature setting $T_2$, current is permitted to spread into the second layer 106 by increasing power even after $T_1$ is obtained. Control is as follows: If T is less than $T_1$, the power controller continues to output maximum power even when the reflected resistance drops during passage through $T_1$. If T is greater than $T_1$, but less than $T_2$, the temperature from the additional heating and the contribution from the second magnetic layer 106 ($T_2$ layer) continues to rise.

The contribution of heating from the second layer (e.g., layer 106) can be optimized by an appropriate choice of thickness of the second layer 106 and the frequency of operation. The thickness of layer 104 can be selected to be less than a skin depth at the frequency of operation used to select $T_1$ for operation where T is greater than $T_1$ and less than $T_2$. Those skilled in the art will recognize however, that the system will work even if most of the heat is generated in layer 104 as long as the power supply can detect the change in reflected resistance when T passes through the Curie temperature $T_1$.

A change in frequency can be used to change the reflected resistance associated with each operating point (i.e., change the switching ratio). The system can operate under two or more significantly different frequencies for $T_1$ and $T_2$, with additional capacitance being switched into the circuit.

With regard to the control of temperature $T_2$, when the power supply detects that T is greater than $T_1$ and begins to detect a redirection in reflected resistance, the power supply again attempts to limit power by keeping current constant. This can be achieved, for example, by increasing frequency and/or reducing duty cycle until ambient heat loss matches power into the system and the reflected resistance stabilizes.

A heater structure in accordance with the FIG. 1 embodiment can be formed by laminating a higher temperature sheet used to form the second layer 106 (e.g., 0.015 inch alloy) to a first side of an aluminum core layer. The aluminum core layer can, for example, be 0.090 inches thick. The 0.015 inch alloy which is laminated to the aluminum core layer can, for example, be Alloy 35. A first layer 104 can be formed as a 0.015 inch alloy laminated to the Alloy 35 layer. The first layer can, for example, be Alloy 32. The lower temperature Alloy 32 used to form the first layer can be chosen with a relative thickness with respect to the Alloy 35 of the second layer to permit detection of electrical properties (e.g., reflected resistance) of the Alloy 35. Alternately, a small pick-up coil can be used to detect electrical characteristics of the Alloy 35.

Figure 2:
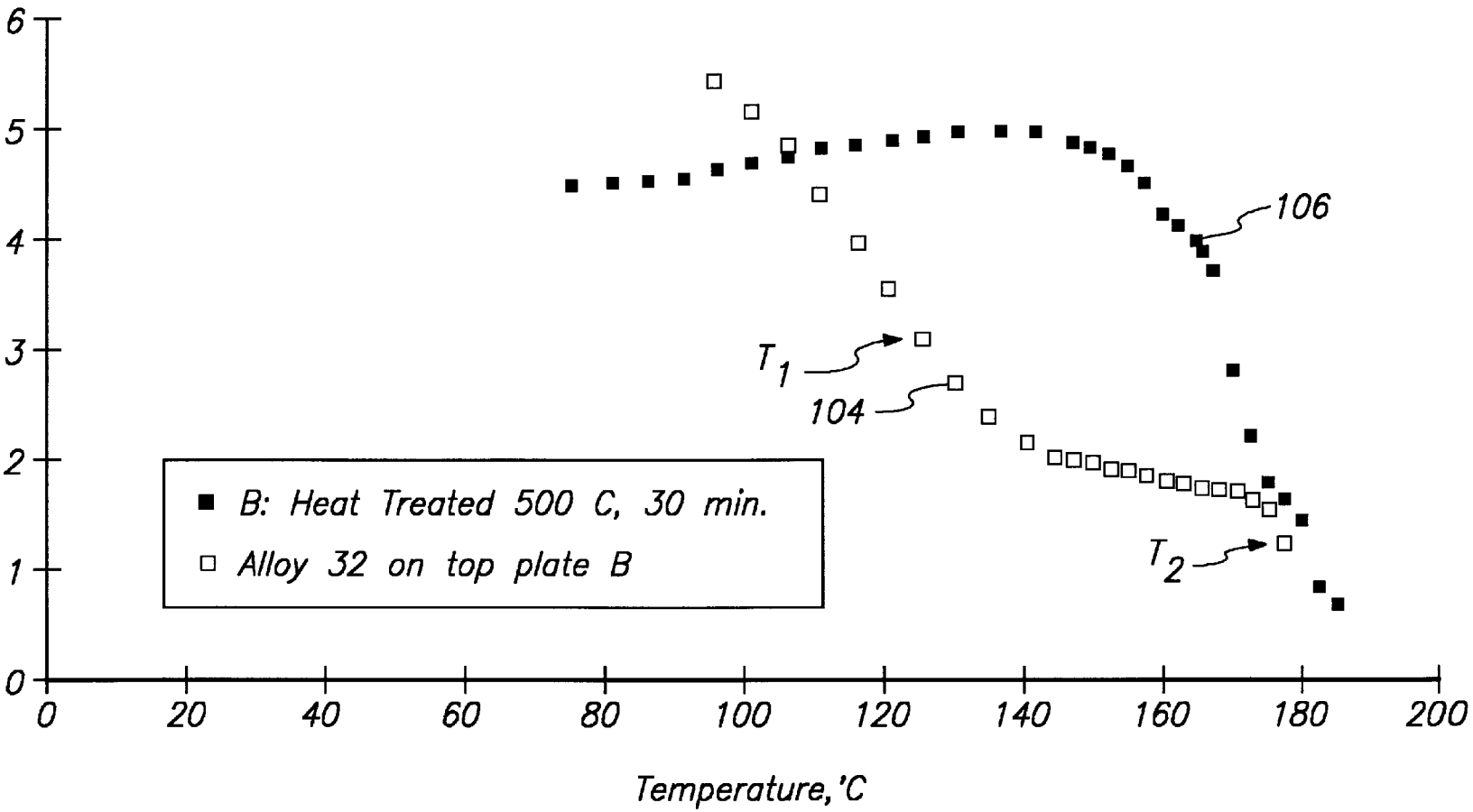
FIG. 2 shows a graphical representation of reflected resistance versus temperature for a dual temperature heater structure.

FIG. 2 illustrates exemplary electrical properties (e.g., resistance in ohms versus temperature) for the exemplary materials described with respect to layers 104 and 106 of FIG. 1. As illustrated in FIG. 2, each of the magnetic layers 104 and 106 exhibits a drop in reflected resistance at a given temperature. In accordance with the present invention, this characteristic of hi $\mu$ magnetic materials is monitored and used to permit temperature control at plural predetermined operating points (i.e., temperature settings).

Figure 3:
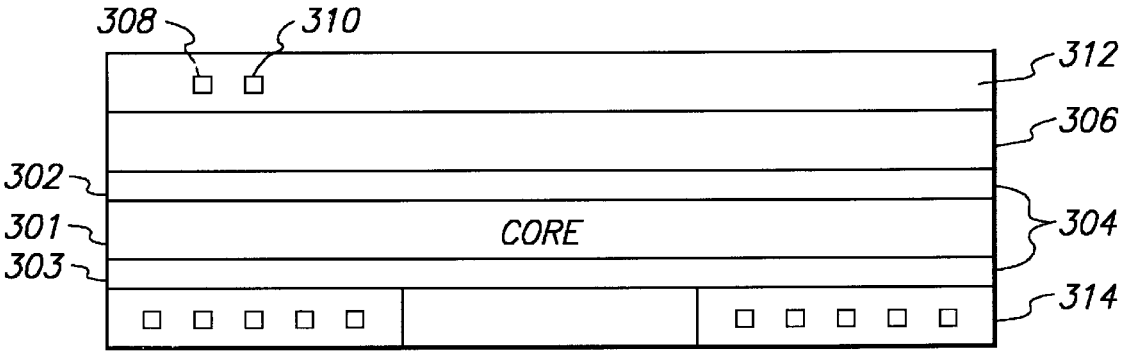
FIG. 3 shows a heater structure by which reflected resistance versus temperature curves can be obtained while the heater structure is cooled.

FIG. 3 illustrates a method by which reflected resistance versus temperature curves can be obtained while the heater structure is cooled. In FIG. 3, an aluminum layer included in a CMI annealed plate 304 (e.g., a plate formed with sequential layers 301, 302 and 303 of Alloy 34, aluminum and Alloy 34, respectively) is used as a core layer. The layer 302 of the Alloy 34 included in the annealed plate 304 serves as a high temperature layer. A layer 306 can be formed, for example, of Alloy 32 adjacent layer 302 on a first side of the core layer as the first, relatively lower temperature layer.

A standard pick-up coil 308 located on the first side of core layer 304 can be used to detect current induced in the plate structure by a power source 314 (e.g., inductively coupled coils) located on a second side of the core. A K-type thermo-couple 310 can be used to detect surface temperature of the structure (both the pick-up coil and thermo-couple can be mounted within a thermal insulation material 312).

In the exemplary FIG. 3 structure, the annealed plate 304 can include an aluminum core 301 of 0.090 inches in conjunction with magnetic layers 302 and 303 of Alloy 34, each having an exemplary thickness of 0.015 inches. The layer 306 of Alloy 32 can have a thickness of, for example, 0.015 or 0.030 inches.

Figure 4:
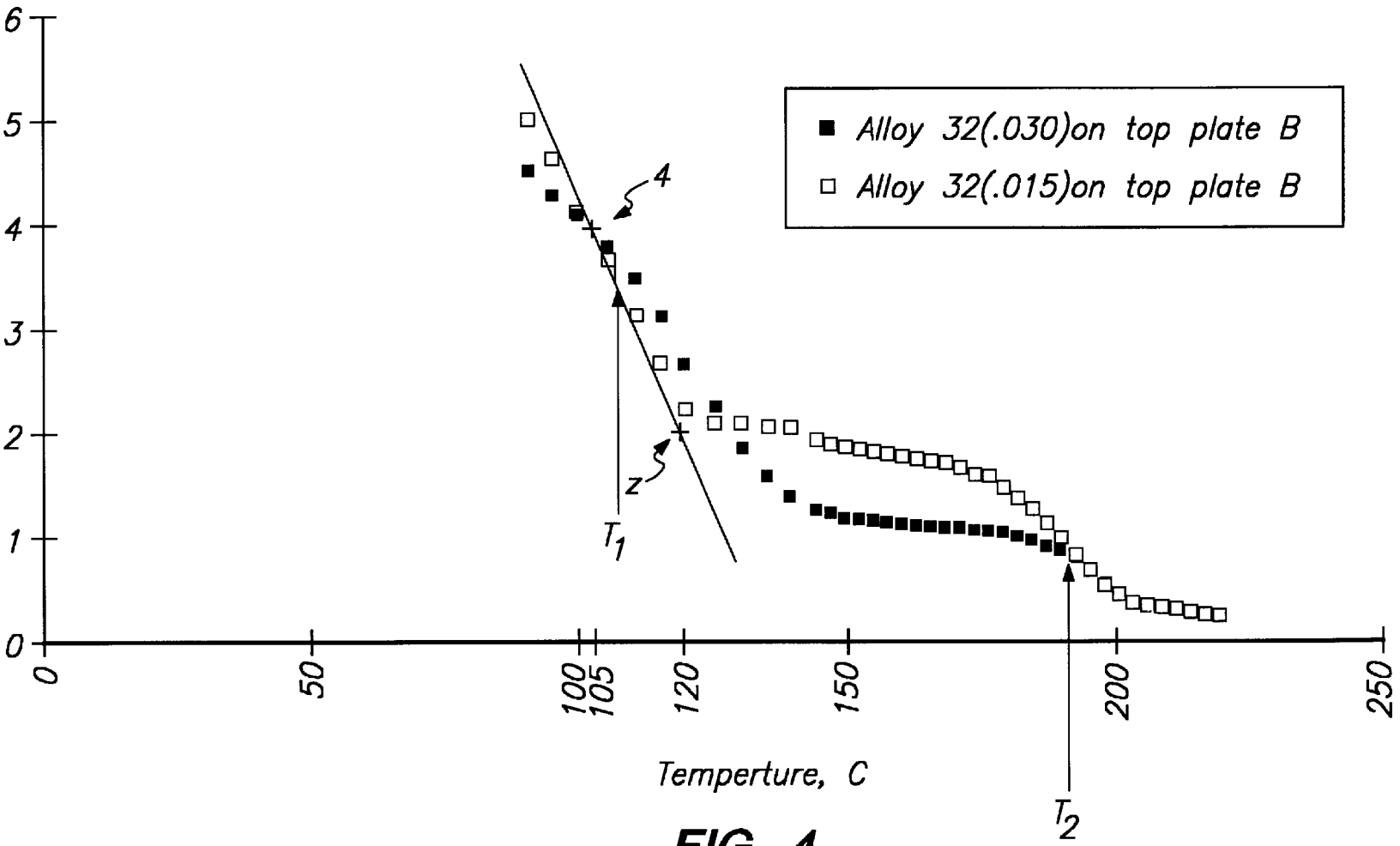
FIG. 4 shows a graphical representation of reflected resistance versus temperature for a dual temperature heater in accordance with an exemplary embodiment of the present invention.

Reflected resistance versus temperature curves can be obtained while the heater structure is cooled. Resulting curves are illustrated in FIG. 4 for cases where Alloy 32 layers of different thicknesses are present. FIG. 4 illustrates that at low temperatures for T less than $T_1$ (where $T_1$ corresponds to the Alloy 32 Curie temperature), most of the current is restricted to the layer 306 of Alloy 32. On the contrary, when T is greater than $T_1$, the current spreads into the layer 302 of Alloy 34 included in the annealed plate 304 which is below its Curie temperature. This relatively high reflected resistance layer of the annealed plate 304 is in parallel with the now low reflected resistance layer 306 of Alloy 32 and an intermediate reflected resistance can be detected.

When T reaches $T_2$ (i.e., the Curie point of the Alloy 34 in the annealed plate 304), the magnetic permeability of the overall structure drops and skin depth grows until not only is the layer 302 of Alloy 34 in the annealed plate 304 conducting current, but also the core aluminum layer is conducting current as well. The reflected resistance now drops to a final value of approximately 1 ohm from a resistance of approximately 4 ohms per 3–4 skin depths when T is greater than $T_1$.

In accordance with the present invention, heat control at any number of distinct transition temperatures $T_1$ and $T_2$ can be obtained. For structures which include two operating points (for example, the two operating points $T_1$ and $T_2$ determined using the FIG. 3 structure), the reflected resistance falls rapidly at $T_1$ and $T_2$ such that accurate temperature control is possible. For example, resistance can be maintained to within plus or minus 10% or lower of the set value. This translates into a temperature accuracy of 107.5±2.5° C. at $T_1$ and 188.5±2.0° C. at $T_2$ or better.

Those skilled in the art will appreciate that the plural layers of magnetic material in exemplary embodiments described herein can be formed in direct contact with one another, or can be formed to include a dielectric as an interface between layers. In alternate embodiments, any of numerous materials can be selected with thicknesses for achieving desired operation.

In accordance with alternate embodiments, an additional layer or layers of magnetic material can be arranged on both sides of the core (e.g., both the first side and a side opposite the first side of the core) with the additional layers having characteristics which balance the mechanical characteristics of the layers formed on the first side. In addition, a layer can be included as a ferromagnetic layer for shielding magnetic fields and for balancing coefficients of thermal expansion of the various layers used to form the heater structure.

Figure 5:
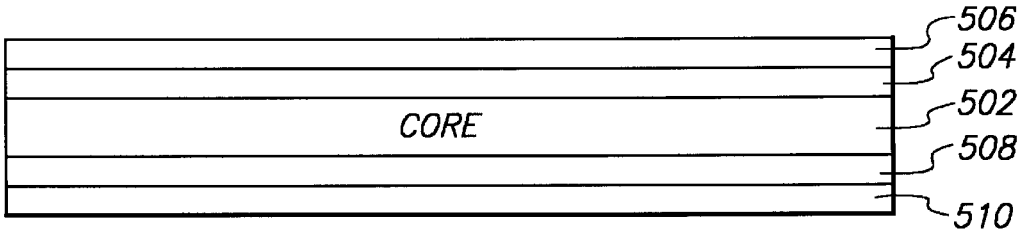
FIG. 5 shows an alternate embodiment of a heater structure having a symmetrical configuration in accordance with the present invention.

FIG. 5 illustrates an exemplary embodiment of a heater structure having a symmetrical design which includes a core layer 502, an Alloy 34 layer 508 and an Alloy 31 layer 510. Symmetrically positioned on an opposite side of the core layer 502 is a second Alloy 34 layer 504 and a second Alloy 31 layer 506. The conductive, non-magnetic core layer (e.g, aluminum) can be, for example, 0.090 inches thick, while the Alloy 34 layers can be each 0.015 inches thick and the Alloy 31 layers can be each 0.018 inches thick. Using a constant current supply with a frequency of 33 kHz, the skin depth is small enough that most of the switching from high to low reflected resistance occurs within the relatively low temperature Alloy 31 with a reflected resistance ratio of 6 ohms: 2 ohms before the current enters the higher temperature Alloy 34.

Those skilled in the art will recognize that while the foregoing exemplary embodiments have been described with respect to relatively planar structures, the present invention can be applied to any structure including the soldering iron described previously. Alternately, the present invention can be applied to cylindrical embodiments wherein the core is formed as a wire laminated with cylindrically shaped layers of magnetic materials. Any such number of these materials can be included. Those skilled in the art will appreciate that it is not the specific shape which is important to implementing the present invention, but rather the manner by which current passing through multiple layers of magnetic material having multiple Curie temperatures is achieved.

Figure 6A:
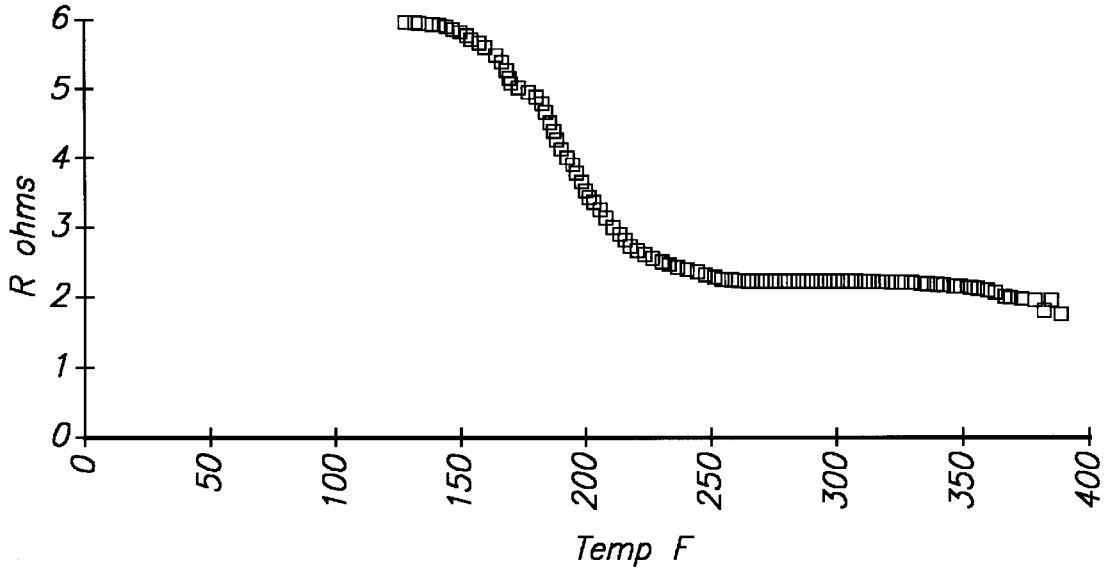
FIGS. 6*a* and 6*b* show graphical representations of reflected resistance versus temperature for dual temperature heater structures in accordance with the present invention.
Figure 6B:
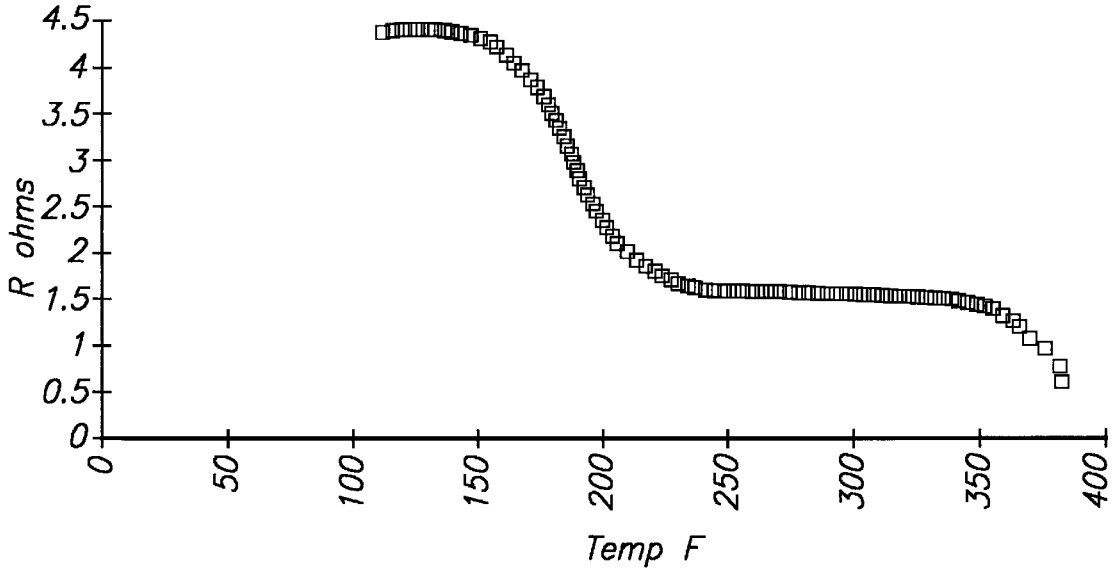

FIGS. 6*a* and 6*b* illustrate dual temperature operation in accordance with an exemplary embodiment of the present invention. At a lower frequency of a power supply, the skin depth is larger and at the lower temperature (e.g., 200° F.), most of the switching occurs in the low temperature layer of Alloy 31. However, as the heater structure continues to absorb energy and heat, the lower frequency (i.e., larger skin depth) current escapes the Alloy 34 layer into the aluminum core and provides switching at the higher 380° F. Curie temperature of the Alloy 34 layer.

In accordance with exemplary embodiments, a controller can be matched to a multi-temperature heating structure to provide precise temperature control of multiple temperatures by adjusting $R_{setpoint}$, $I_{constant}$ and the power to stabilize the heater structure. Resonant frequency can be matched with an intermediate frequency using data obtained empirically. For example, by setting the capacitance and inductance so that frequency $f_0$ is 33 kHz, then for a given temperature, a sweep from 33 kHz under constant current up to a range of from 60 to 80 kHz can be performed. For the higher temperature of Alloy 34, a sweep from 33 kHz down to 15 kHz can be performed. Thus, the impact from the outer Alloy 31 layer is masked (i.e., large skin depth) while at the lower temperature Alloy 31, sweeping from 33 kHz to 70 kHz keeps the skin depth small and out of the Alloy 34 layer.

In general, by modifying the frequency of the power supply as described above, each of the two Curie temperature layers can be independently selected. In an exemplary embodiment, this can be obtained by searching and seeking final reflected resistance and by keeping the power low enough to acquire the lower temperature Curie point material.

Having discussed a heater structure which can provide switching characteristics at two or more distinct temperatures, attention will now be directed to an exemplary power supply circuit for controlling the heater structure to select one of the plural operating points. In accordance with exemplary embodiments, a power supply can control power, current and reflected resistance independently. Under normal operation, the power supply initiates a constant current mode near or at maximum power. If reflected resistance is relatively flat (i.e., stable) below the Curie temperature, then current is set slightly lower than the maximum current to provide slightly lower than the maximum power. $P_{max}=I^2\times R_{max}$ where $R_{max}$ is the maximum reflected resistance and I is constant. Once the power supply operates under a maximum current, as a Curie temperature is reached and R begins to decrease, power begins to decrease. In this region, the reflected resistance is compared to a predetermined value $R_{setpoint}$. If the value $R_{setpoint}$ is set high, then the current required to control at this value is near $I_{constant}$. However, if $R_{setpoint}$ is chosen sufficiently low, then current will continue to be reduced until the reduced power matches the minimum power required to maintain thermal equilibrium at this lower resistance value.

Figure 7:
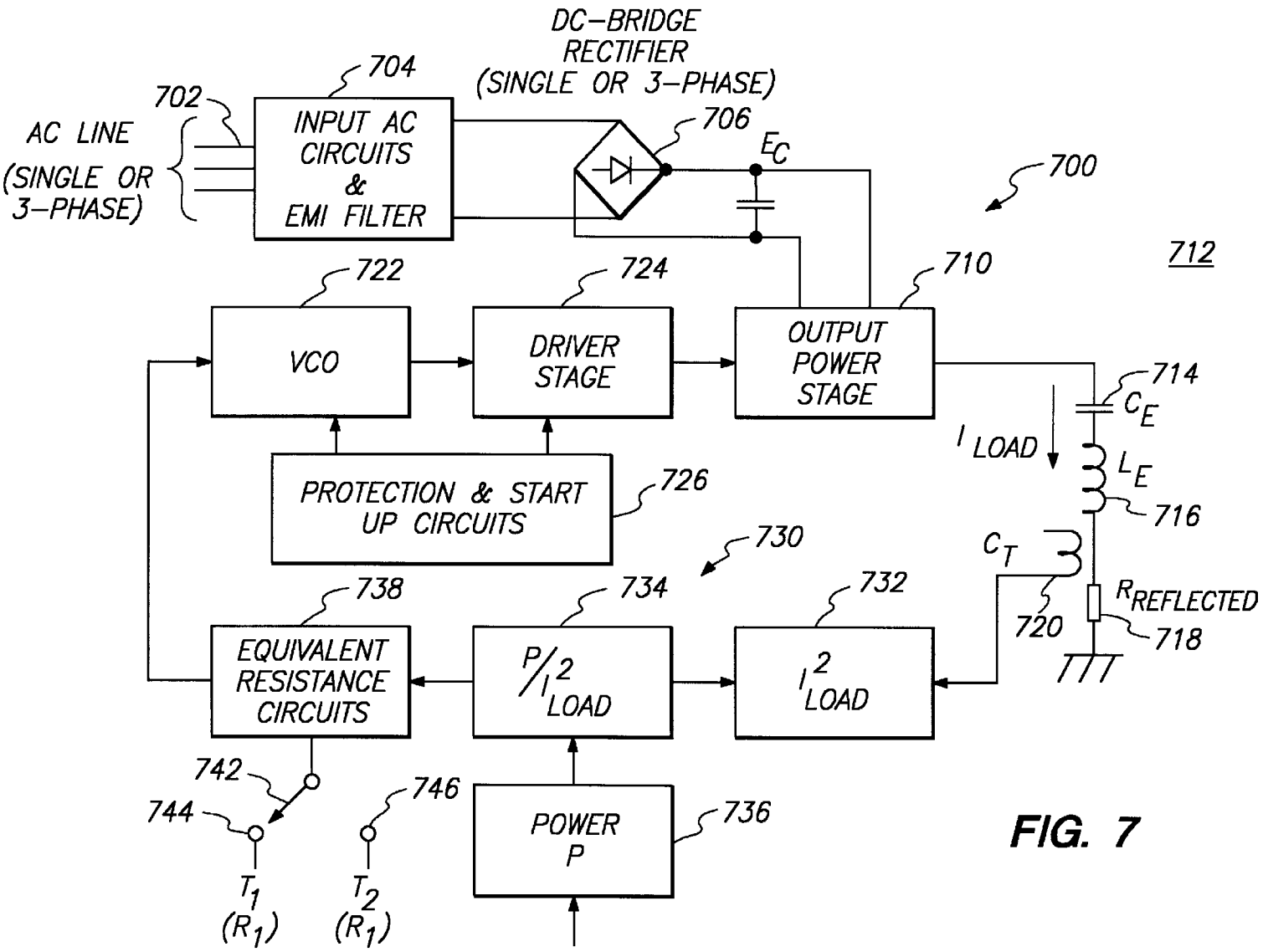
FIG. 7 shows an exemplary embodiment of a dual temperature current control.

FIG. 7 illustrates an exemplary block diagram of a dual temperature control system for use in conjunction with the exemplary plate structures described in accordance with the present invention. In an exemplary embodiment, the FIG. 7 circuit can be a low frequency resonant converter which operates in a frequency range of, for example, 10 kHz to 100 kHz or greater.

The FIG. 7 circuit is generally designated 700 and includes a single phase or three-phase alternating current (AC) input line 702. The input AC power is applied to input AC circuits and an electromagnetic interference (EMI) filter 704. Outputs from the AC circuits and filter 704 are applied to a DC bridge rectifier 706. In the FIG. 7 example, the DC bridge rectifier can accommodate either the single phase or three phase input. A capacitor 708 is connected in parallel with the output of the DC bridge 706, and voltage across the capacitor is applied to an output power stage 710. In alternate embodiments, capacitors (e.g., 1 microfarad capacitors) can be added in parallel to each of the one-half bridge circuits to reduce resonance frequency.

The output power stage 710 is a switching circuit for applying a load current $I_{load}$ to the heater structure constituting the load of the FIG. 7 circuit. The output load represented by the heater structure can be a plate structure as described above with respect to FIGS. 1–6, or can be of any desired shape (e.g., cylindrical, conical and so forth). In the exemplary FIG. 7 embodiment, the output load of the laminated plate structure is represented by an output resonant circuit 712 shown to include a capacitance 714 (labeled $C_e$), an inductance 716 (labeled $L_e$) and a reflected resistance 718 (labeled $R_{reflected}$).

A current transformer 720, designated $C_t$ is coupled to the output load of the heater structure to provide feedback to a current control means. The current control means includes the output power stage 710. In addition, the current control means includes a voltage controlled oscillator 722 and an amplifier, represented as a driver stage 724, for driving the output power stage 710. Protection and start-up circuits 726 can be provided for the voltage controlled oscillator and the driver stage, respectively.

Output current from the current transformer 720 is applied to a power detection means 730. The power detection means 730 includes a block 732 labelled $I_{load}^2$ representing means for monitoring power by calculating the square of the detected current. The power detection means further includes a power detection block 734 designated $P/I_{load}^2$ for determining load. The power detection means also includes a power input designated 738 which supplies power to the power detection block, and can input AC power of medium accuracy or a true value of output load power.

Equivalent resistance circuits designated 738 receive the detected power, and are adjusted in response to operator controlled temperature setting switches 742. Via the temperature setting switch 742, the operator can select a first temperature setting $T_1$ via a contact 744, or a temperature $T_2$ corresponding to a resistance $R_2$ via a temperature setting contact 746. Outputs from the equivalent resistance circuits are applied to voltage controlled oscillator 722 to adjust frequency output of the voltage controlled oscillator.

In operation, a non-linear load represented by the heater structure can be designated with a value of $R_{reflected}$ . The value $R_{reflected}$ can generally be considered a function of frequency and temperature as illustrated, for example, with respect to FIGS. 6*a* and 6*b* described above. To maintain a constant temperature at any of the plural exemplary settings specified (e.g., $T_1$ or $T_2$), values of reflected resistance $R_{reflected}$ are determined based on the type of load used and the direction in which the curve $R_{reflected}$ versus temperature is explored. Given these parameters, the frequency of the voltage controlled oscillator in the FIG. 7 circuit can be varied to control the output power in a desired region. Due to the nature of the load, a lower regulation ratio in a region near $T_1$ (wherein $T_1$ is less than $T_2$) can be obtained relative to a value corresponding to $T_2$.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for generating heat comprising:

means for generating a relatively constant current; and means for selectively producing heat at any one of plural relatively constant temperatures in response to said constant current generating means, based on reflected resistance of said heat producing means, said heat producing means including:

a core having at least one electrically conductive, non-magnetic material; and at least two layers of magnetic material, a first of said at least two layers having a first Curie temperature and a second of said at least two layers having a second Curie temperature different from said first Curie temperature, said core being cooperatively arranged with said first layer and said second layer to selectively produce heat at said first Curie temperature and said second Curie temperature.

2. Apparatus according to claim 1, wherein said constant current generating means further includes:

means for detecting an operating point of said heat producing means;

means for controlling said constant current generating means to maintain operation at said operating point; and means for selectively adjusting said constant current generating means to change said operating point.

3. Apparatus according to claim 1, wherein said means for adjusting further includes:

a switch for selecting among a first operating point which corresponds to said first Curie temperature and a second operating point which corresponds to said second Curie temperature.

4. Apparatus according to claim 3, wherein said detecting means further includes:

means for detecting an operating point as a function of material resistance.

5. Apparatus according to claim 3, wherein said detecting means further includes:

means for detecting an operating point as a function of power supply from the constant current generating means.

6. Apparatus according to claim 1, further including:

said core being formed of copper, said first layer of said at least two layers being formed of a first alloy having a first Curie temperature and said second layer of said at least two layers being formed of a second alloy different from said first alloy and having a second Curie temperature.

7. Apparatus according to claim 6, further including:

said first layer of said at least two layers being formed of Alloy 34, and said second layer of said at least two layers being formed of Alloy 31.

8. Apparatus according to claim 6, further including:

said core being cylindrically shaped, with said at least two layers being formed concentrically around said core.

9. Apparatus according to claim 1, wherein said constant current generating means further includes:

means for varying the frequency of said constant current to select a switching ratio between selective production of heat at one of said first Curie temperature and said second Curie temperature.

10. Apparatus according to claim 1, wherein said constant current generating means further includes:

means for varying a pulse width of said constant current to select a switching ratio between selective production of heat at one of said first Curie temperature and said second Curie temperature.

11. Apparatus according to claim 1, wherein said core further includes:

first and second sides, both of said at least two layers of magnetic material being arranged on said first side of said magnetic core.

12. Apparatus according to claim 11, further including:

at least two additional layers of magnetic material arranged on a second side of said magnetic core, said at least two additional layers having characteristics which balance characteristics of said at least two layers arranged on said first side.

13. A heater formed as a structure comprising:

at least one electrically conductive, non-magnetic material having at least a first side; and at least two layers of magnetic material arranged on said first side, a first of said at least two layers having a first Curie temperature and a second of said at least two layers having a second Curie temperature different from said first Curie temperature, said at least one electrically conductive, non-magnetic material being cooperatively arranged with said first layer and said second layer to establish first and second operating points, as a function of reflected resistance, which selectively produce heat at said first Curie temperature and said second Curie temperature.

14. Apparatus according to claim 13, further including:

said at least one electrically conductive, non-magnetic material being formed of copper, said first layer of said at least two layers being formed of a first alloy having a first Curie temperature and said second layer of said at least two layers being formed of a second alloy different from said first alloy and having a second Curie temperature.

15. Apparatus according to claim 14, further including said first layer of said at least two layers being formed of Alloy 34 and said second layer of said at least two layers being formed of Alloy 31.

16. Apparatus according to claim 15, further including:

said core being cylindrically shaped, with said at least two layers being formed concentrically around said core.

17. An apparatus for generating a heat supply comprising:

means for selectively producing heat at any one of plural relatively constant temperature operating points of a multilayer structure, each of said operating points being produced by a separate material having a Curie temperature which corresponds to one of said plural constant temperature operating points of said multilayer structure; and means for controlling said heat producing means at one of said operating points as a function of reflected resistance of the heat producing means.

18. Apparatus according to claim 17, wherein said controlling means further includes:

means for generating a constant current, said electrical properties being a function of material resistance.

19. Apparatus according to claim 18, wherein said constant current generating means further includes:

means for detecting an operating point of said heat producing means;

means for controlling said constant current generating means to maintain operation at said operating point; and means for adjusting said constant current generating means to change said operating point.

20. Apparatus according to claim 19, wherein said means for adjusting further includes:

a switch for selecting among a first operating point which corresponds to said first Curie temperature and a second operating point which corresponds to said second Curie temperature.

21. Apparatus according to claim 20, wherein said constant current generating means further includes:

means for varying the frequency of said constant current to select a switching ratio between selective production of heat at one of said first Curie temperature and said second Curie temperature.

22. Apparatus according to claim 20, wherein said constant current generating means further includes:

means for varying a pulse width of said constant current to select a switching ratio between selective production of heat at one of said first Curie temperature and said second Curie temperature.

23. Method for generating a heat supply comprising the steps of:

selectively producing heat at any one of plural relatively constant temperature operating points of a multilayer structure, each of said operating points being produced by a separate material having a Curie temperature which corresponds to one of said plural constant temperature operating points of said multilayer structure; and controlling said separate Curie temperature materials at one of said operating points as a function of reflected resistance during selective heat production.

* * * * *